US006033276A

United States Patent [19]

Han

[11] Patent Number: 6,033,276

[45] Date of Patent: Mar. 7, 2000

[54] PERSONAL WATER VEHICLE

[76] Inventor: Sukkyu Han, 325 Bogert Avenue, Apt. L32, North York, Ontario, Canada, M2N 1L8

[21] Appl. No.: 09/134,960

[22] Filed: Aug. 17, 1998

[51] Int. Cl.[7] ..... B63C 11/00

[52] U.S. Cl. ..... 441/135; 440/26; 114/315

[58] Field of Search ..... 114/315, 66; 441/135, 441/65; 440/26

[56] References Cited

U.S. PATENT DOCUMENTS 2,926,365 3/1960 Wilcoxon ..... 441/135

2,990,805 7/1961 Jacus ..... 440/26

3,042,945 7/1962 Saeman ..... 441/135

*Primary Examiner*—Stephen Avila

*Attorney, Agent, or Firm*—Michael I. Kroll

[57] ABSTRACT

A personal water vehicle (12) comprising a structure (14) for supporting a person (16) in a prone position above an upper surface of a body of water (18). A facility (20) is for steering the supporting structure (14) in the body of water (18), using manual operation by the hands (22) of the person (16). An assemblage (24) is for propelling the supporting structure (14) in the body of water (18), using peddle movement by the feet (26) of the person (16). A device (28) for viewing, extends through the supporting structure (14), so that the person (16) can look into the body of water (18).

15 Claims, 6 Drawing Sheets

PERSONAL WATER VEHICLE

BACKGROUND OF THE INVENTION

1. Field of the Invention

The instant invention relates generally to watercrafts and more specifically it relates to a personal water vehicle. The personal water vehicle allows a person in a prone position on a buoyant support member, to manually steer by hand and pedal by foot to cause a tail fin assembly to work as a rudder and also undulate like a fish tail in a body of water, to propel it forward for a safe and exciting outdoor water adventure activity. The personal water vehicle contains a see through window, so that the person in the prone position on the buoyant support member can look into the body of water for sightseeing, researching and hunting.

2. Description of the Prior Art

Numerous watercrafts have been provided in prior art. For example, U.S. Pat. No. 4,172,427 to Kindred; U.S. Pat. No. 4,389,195 to Sohaei; U.S. Pat. No. 4,840,592 to Anderson; U.S. Pat. No. 4,925,417 to Warren; U.S. Pat. No. 5,127,855 to Heywood and G.B. Patent Numbered 1,397,456 all are illustrative of such prior art. While these units may be suitable for the particular purpose to which they address, they would not be as suitable for the purposes of the present invention as heretofore described.

KINDRED, WILLIAM B.

WATER PROPULSION UNIT INCLUDING FIN HAVING FOIL AND FLEXIBLE ENDS

U.S. Pat. No. 4,172,427

A propulsion unit for driving watercraft, particularly those of the floating lounge type, is disclosed as including a fin made from a flexible material with a first end formed to define a foil into which the lower end of an oscillatory drive member projects downwardly in a fixedly secured relationship and with a second flexible fin end that extends from the foil end to provide a flapping movement through the water upon oscillation of the drive member in order to propel the watercraft. Movement of the drive member through the water is facilitated by the foil shape of the first fin end which is also more rigid than the second flexible end, so as to increase the moment arm about the drive member where the flexible flapping movement is concentrated. Flexible sheet plastic is preferably used to form the fin with a folding operation at a score line to define the foil shape. A journal in the form of a tube receives an intermediate portion of the drive member to provide mounting thereof and is connected to the first end of a mounting bar which has a pair of spaced mounts for securing the unit to the frame of a water lounge. One of the mounts includes a saddle-like member and a cooperable fastener for securing the first end of the mounting bar to the frame. The other mount may include either a flattened hook shape portion of a second end of the mounting bar and a cooperable fastener or a flattened portion of the second mounting bar end which is inserted within a hole in the lounge frame. A foot actuator bar for the unit is secured to the upper end of the drive member, either by a welded connection or a hollow T-shaped connector. Best results are achieved when the length of the flexible fin end is between about 1.4 and 1.8 times the length of the foil fin end.

SOHAEI, IRAJ

STEERABLE SURFBOARD

U.S. Pat. No. 4,389,195

A steerable, self-propellable surfboard has a steering arrangement attached to a weight-bearing buoyant member such as normally forms a surfboard and arranged for being actuatable by a surfer lying prone on the buoyant member and permitting the surfboard to be maneuvered under control through a liquid in which the surfboard is disposed. The steering arrangement includes a rudder assembly arranged for changing a direction of travel of the surfboard, and a fin assembly which permits the surfer to propel the surfboard through a calm liquid body by causing the member to fish tail or undulate through the liquid in which the surfboard is traveling.

ANDERSON, ALLEN B.

POWER DRIVEN UNDERWATER VIEWING PLATFORM

U.S. Pat. No. 4,840,592

An underwater viewing platform is described which has a stern mounted electric drive motor whose direction and speed may be varied by forward mounted controls located adjacent the prone-lying operator's hands near a large forward mounted viewing window. A shade cowl arches up over the viewing window and has a U-shaped stern-facing, padded opening for receiving the operator's head. With the operator's head in place, the large viewing window is substantially shaded from overhead sunlight and has a large viewing angle and field view. The window has a lens for providing the desired degree of magnification or demagnification. Bottom illumination is provided by an underwater light for night time use. Navigation and battery status and drain instruments are conveniently mounted within or on the shade cowl. Various design features reduce operator fatigue and extend useful range and endurance. End useful range and endurance.

WARREN, JOHN R.

UNDERWATER VIEWING PADDLE BOARD

U.S. Pat. No. 4,925,417

An apparatus for underwater surveillance that consists of a floating platform having bow and stern with an aerodynamically true forward cowl formed on the bow end, the forward approximately one-third of the platform. Immediately aft of the cowl there is disposed a viewing assembly placed in a clearance formed centrally through the platform, and the viewing assembly is a tightly sealed transparent member having top panel, bottom panel and side panel and defining a volume that is maintained liquid free thereby to enable maximum viewing efficiency at all times.

HEYWOOD, WILLIAM O.

WATER-BORNE VEHICLE

U.S. Pat. No. 5,127,855

A water-borne vehicle with floats, a frame which is mounted on the floats providing a seat and a steering mechanism, and a propulsion means for propelling the vehicle in the water. The propulsion means comprises a plate which is generally parallel to the surface of the water and which is displaced up and down by a foot pedalled crank. A connecting arm is attached at one end rigidly and perpendicularly to the plate and at the opposite end to the crank. The horizontal position of the plate is maintained by an upright member which is slideably retained between rollers that maintain its upright position and is pivotally attached to the plate. As the crank is rotated, one end of the connecting arm follows a circular path, displacing the plate upward and downward. As the plate oscillates up and down, the upright member slides up and down between the rollers and maintains the horizontal position of the plate as directly below the upright member. The angle of the plane of the plate with respect to the surface of the water is varied during the up and down motion of the plate to effect a rearward force on the water, propelling the vehicle forward.

WARREN, ARTHUR WYATT

BUOYANT BOARD

U.S. Pat. No. 1,397,456

A buoyant board comprising a rigid, substantially flat, elongate base portion, of buoyant material. A pair of elongate fins extend generally longitudinally of the base portion and project from the underside surface thereof, such as to be substantially equally spaced from the longitudinal axis of the base portion. The base portion has an aperture therethrough, the axial ends of which are closed by respective sheets of a transparent material, so as to form an observation window through the base portion.

SUMMARY OF THE INVENTION

A primary object of the present invention is to provide a personal water vehicle that will overcome the shortcomings of the prior art devices.

Another object is to provide a personal water vehicle in which a person in a prone position on a buoyant support member can manually steer by hand and pedal by foot to cause a tail fin assembly to work as a rudder and also undulate like a fish tail in a body of water, to propel it forward for a safe and exciting outdoor water adventure activity.

An additional object is to provide a personal water vehicle with a see through window, so that the person in the prone position on the buoyant support member can look into the body of water for sightseeing, researching and hunting.

A further object is to provide a personal water vehicle that is simple and easy to use.

A still further object is to provide a personal water vehicle that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
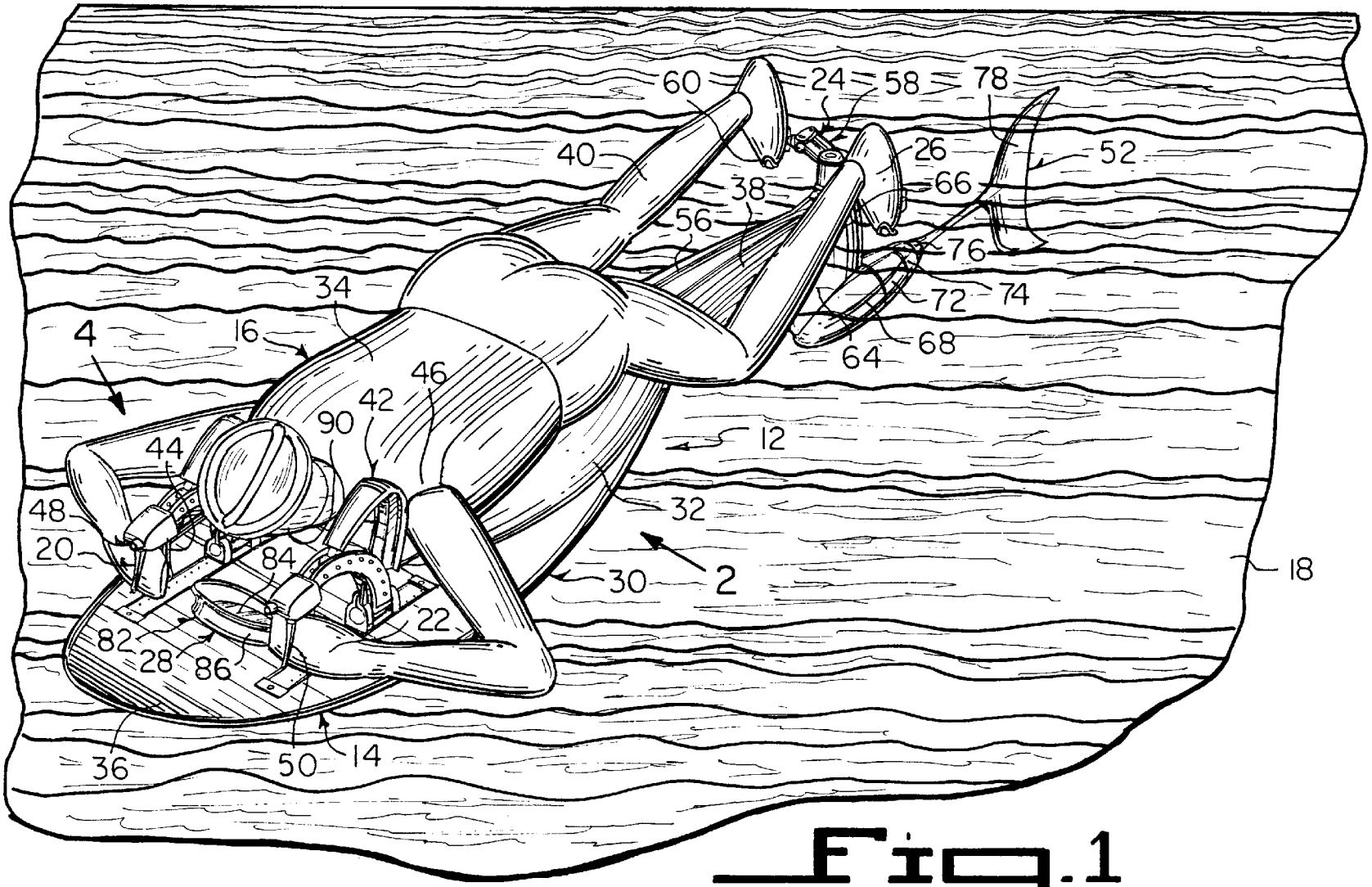
FIG. 1 is a perspective view of the present invention being used in a body of water.
Figure 2:
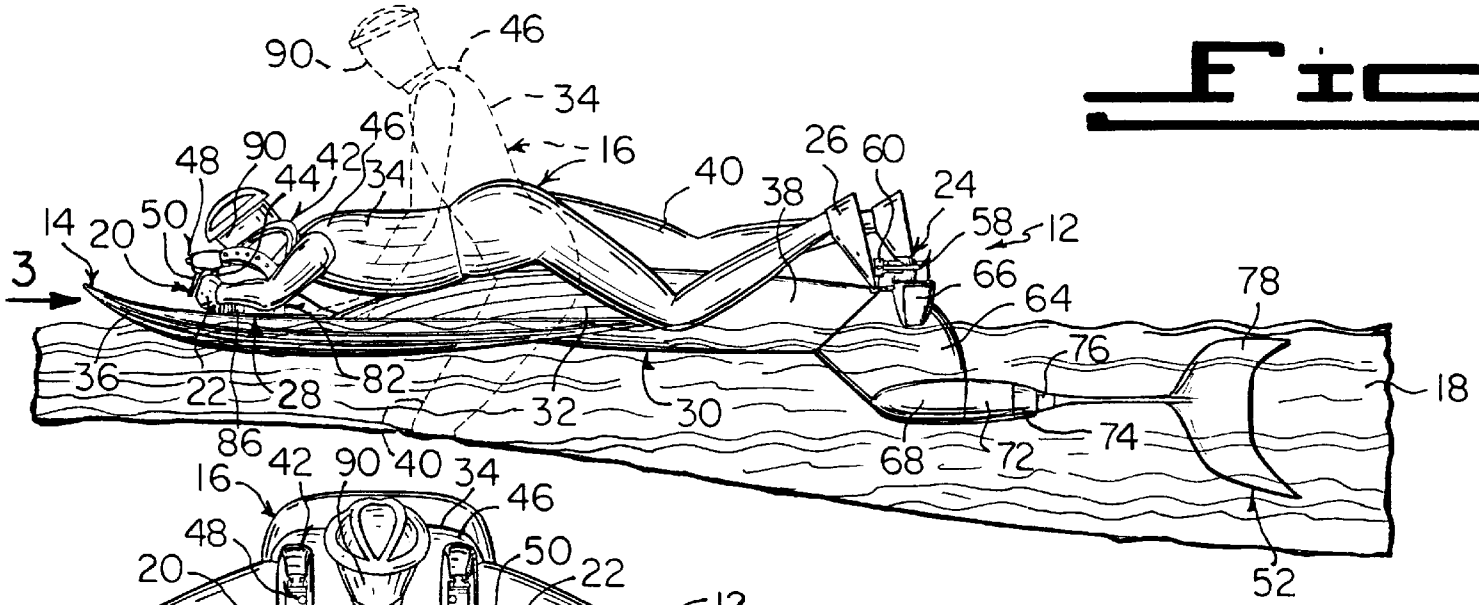
FIG. 2 is a side view taken in the direction of arrow 2 in FIG. 1.
Figure 3:
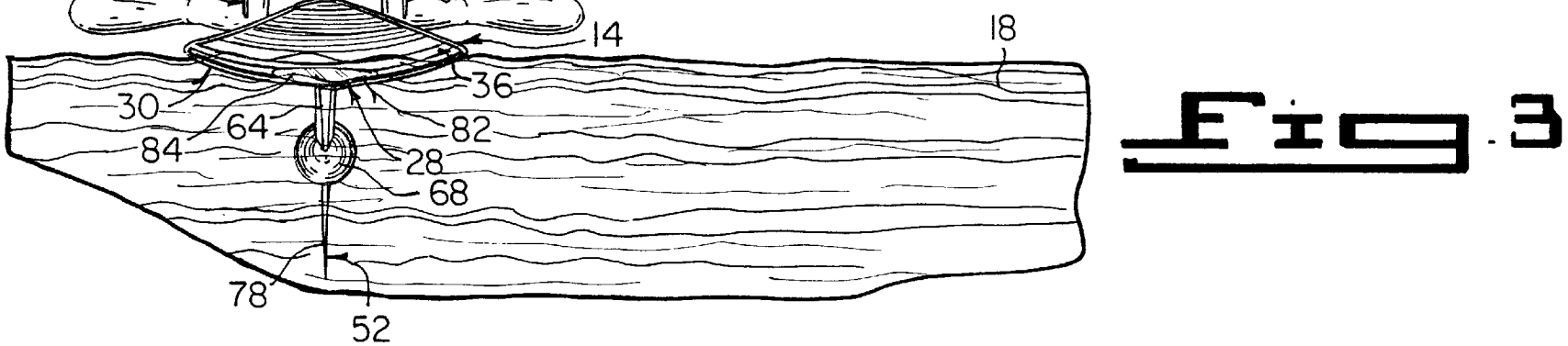
FIG. 3 is a front view taken in the direction of arrow 3 in FIG. 2.

Turning now descriptively to the drawings, in which similar reference characters denote similar elements throughout the several views, FIGS. 1 through 11 illustrate the present invention being a personal water vehicle 12. With regard to the reference numerals used, the following numbering is used throughout the various drawing figures.

| | |
|---|---|
| 12 | personal water vehicle |
| 14 | supporting structure of 12 |
| 16 | person |
| 18 | body of water |
| 20 | steering facility of 12 |
| 22 | hand of 16 |
| 24 | propelling assemblage of 12 |
| 26 | foot of 16 |
| 28 | viewing device of 12 |
| 30 | buoyant support member for 14 |
| 32 | upper body support portion of 30 |
| 34 | upper body of 16 |
| 36 | flat streamlined head portion of 30 |
| 38 | elongated stem portion of 30 |
| 40 | leg of 16 |
| 42 | adjustable shoulder support pad assembly of 20 |
| 44 | grip handle on 42 |
| 46 | shoulder of 16 |
| 48 | adjustable cable control gear unit of 20 |
| 50 | steering lever of 20 |
| 52 | tail fin assembly of 20 |
| 54 | steering gear unit of 20 |
| 56 | elongated steering control cables of 20 |
| 58 | swivel pedal assembly of 24 |
| 60 | toe clip foot hanger pedal of 24 |
| 62 | propulsion gear box of 24 |
| 64 | vertical stabilizer of 52 |
| 66 | pedal mount of 52 |
| 68 | gear housing of 52 |
| 70 | pedal column of 58 |
| 72 | housing cap of 52 |
| 74 | flexible rubber cover on 72 |
| 76 | tail fin mount base on 74 |
| 78 | tail fin of 52 |
| 80 | shaft of 62 and 54 |

-continued

| | |
|---|---|
| 82 | see through window for 28 |
| 84 | transparent plastic lens of 82 |
| 86 | soft rubber face piece of 82 |
| 88 | air and water extractor vent in 86 |
| 90 | face of 16 |
| 92 | storage compartment in 32 of 30 |
| 94 | cover of 92 |
| 96 | hinge between 94 and 92 |
| 98 | latch mechanism between 94 and 92 |

The personal water vehicle 12 comprises a structure 14 for supporting a person 16 in a prone position above an upper surface of a body of water 18. A facility 20 is for steering the supporting structure 14 in the body of water 18, using manual operation by the hands 22 of the person 16. An assemblage 24 is for propelling the supporting structure 14 in the body of water 18, using peddle movement by the feet 26 of the person 16. A device 28 for viewing, extends through the supporting structure 14, so that the person 16 can look into the body of water 18.

The supporting structure 14 is a buoyant support member 30 being hollow, having a bow, stern, deck and hull and fabricated out of a rigid material. The buoyant support member 30 includes an upper body support portion 32 for supporting the upper body 34 of the person 16 in the prone position amidships. A flat streamlined head portion 36 extends forward of the upper body support portion 32. An elongated stem portion 38 extends aft of the upper body support portion 32, to supply clearance for the legs 40 of the person 16 during peddling movement by the feet 26.

The steering facility 20 consists of a pair of adjustable shoulder support pad assemblies 42, each having a grip handle 44 and mounted spaced apart on a forward end of the supporting structure 14 adjacent the starboard side and the port side thereof. The shoulders 46 of the person 16 can engage with the adjustable shoulder support pad assemblies 42, while the hands 22 of the person can grasp the grip handles 44. A pair of adjustable cable control gear units 48 are provided. Each adjustable cable control gear unit 48 is carried in a forward end of one adjustable shoulder support pad assembly 42. A pair of steering levers 50 are also provided. Each steering lever 50 is connected to one adjustable cable control gear unit 48 adjacent one grip handle 44, so as to be manually operable by one hand 22 of the person 16. A tail fin assembly 52 is mounted to a rearward end of the supporting structure 14. A steering gear unit 54 is carried in the tail fin assembly 52. A pair of elongated steering control cables 56 extend between the adjustable cable control gear units 48 and the steering gear unit 54. When each of the steering levers 50 are manually operated by the hands 22 of the person 16, the tail fin assembly 52 will swivel left and right to steer the supporting structure 14.

The propelling assemblage 24 comprises a swivel pedal assembly 58, pivotally mounted over the rearward end of the supporting structure 14 at the tail fin assembly 52. A pair of toe clip foot hanger pedals 60 are provided with each mounted on an opposite end of the swivel pedal assembly 58, to engage with one foot 26 of the person 16. A propulsion gear box 62 is carried in the tail fin assembly 52 in conjunction with the steering gear unit 54. When the swivel pedal assembly 58 is rocked forward and rearward by the peddle movement of the feet 26 of the person 16 engaging the toe clip foot hanger pedals 60, the tail fin assembly 52 will undulate like a fish tail in the body of water 18 to drive the supporting structure 14 forward in the body of water 18.

The tail fin assembly 52 includes a vertical stabilizer 64 attached in a removable manner to the rearward end of the supporting structure 14. A pedal mount 66 is on the vertical stabilizer 64. A gear housing 68 receives the propulsion gear box 62 and the steering gear unit 54 therein, so that a pedal column 70 of the swivel pedal assembly 58 can extend upwardly from the propulsion gear box 62 and through the pedal mount 66. A housing cap 72 with a flexible rubber cover 74 and tail fin mount base 76 engages with the gear housing 68. A tail fin 78 is secured to a shaft 80 of the propulsion gear box 62 and the steering gear unit 54 at the tail fin mount base 76 of the housing cap 72.

The viewing device 28 is a see through window 82. The see through window 82 consists of a transparent plastic lens 84 extending centrally through the supporting structure 14 adjacent a front end thereof. A soft rubber face piece 86 is mounted over the lens 84 in a detachable manner. The face piece 86 has an air and water extractor vent 88, to release any air and water when the person 16 places their face 90 against the face piece 86.

Figures 4, 5:
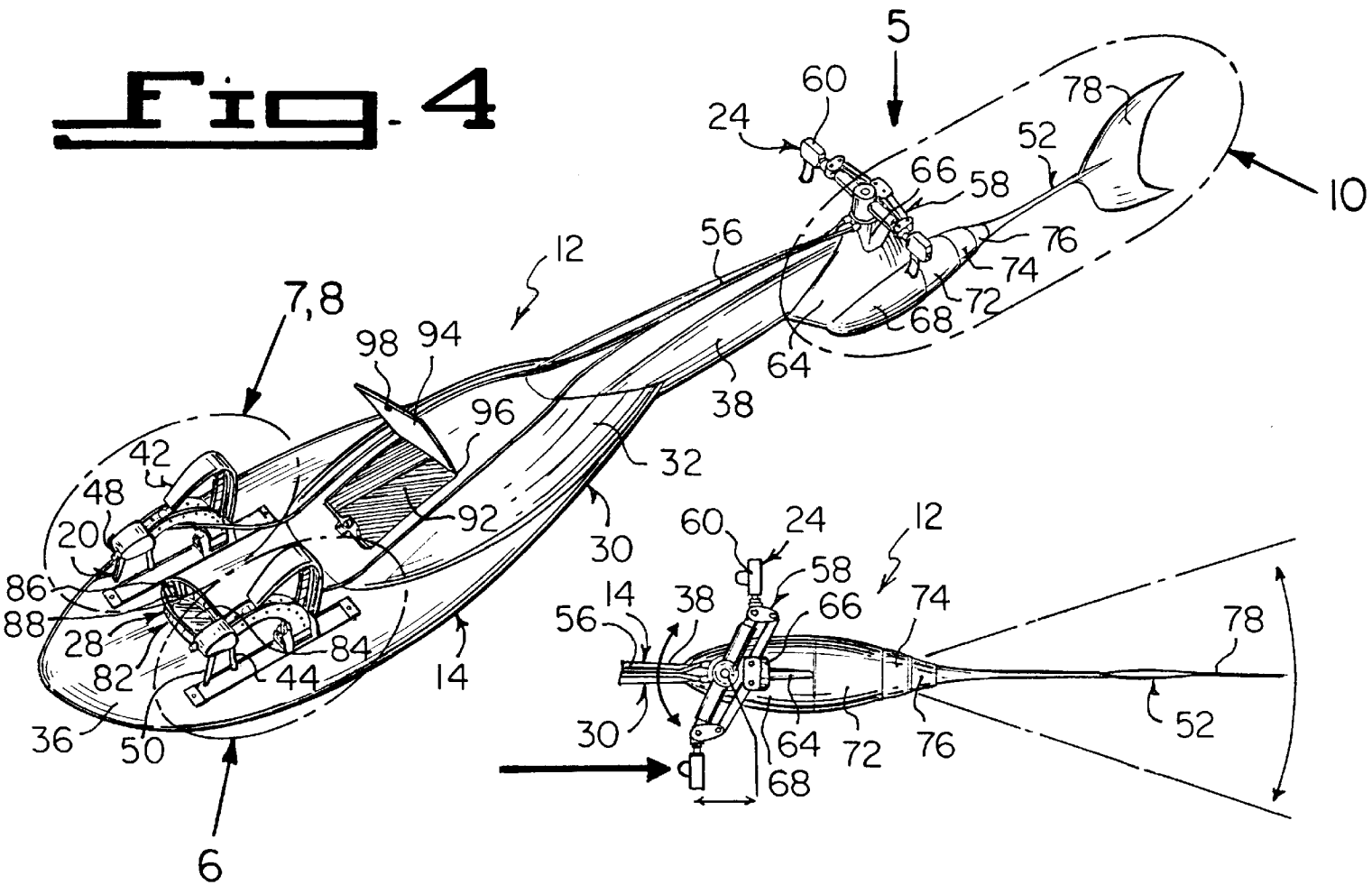
FIG. 4 is a perspective view of the present invention per se.
FIG. 5 is a top view taken in the direction of arrow 5 in FIG. 4, with the forward portion broken away.
Figures 6, 7:
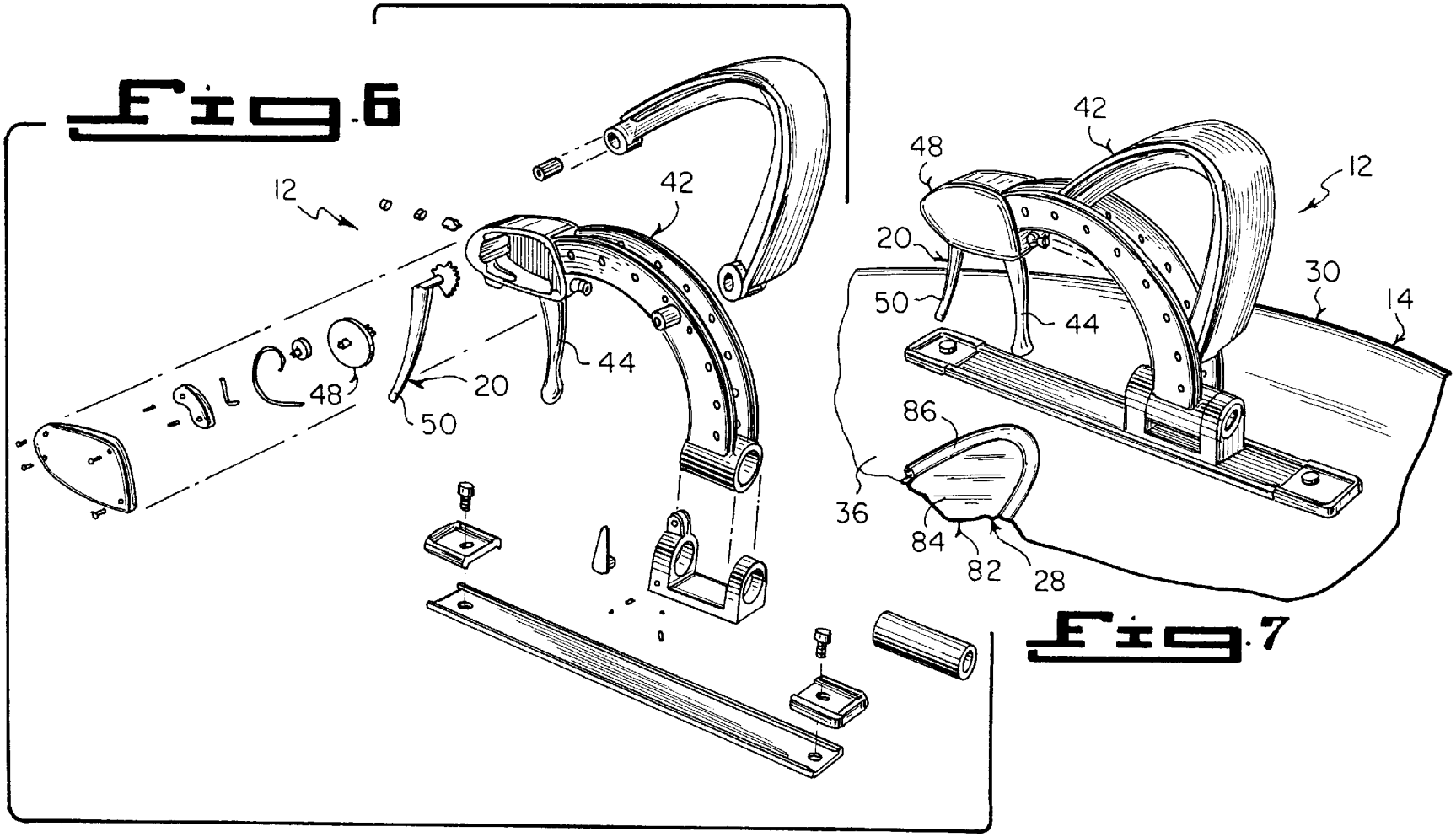
FIG. 6 is an enlarged exploded perspective view of an area in FIG. 4 indicated by arrow 6.
FIG. 7 is an enlarged perspective view of an area in FIG. 4 indicated by arrow 7.
Figure 8:
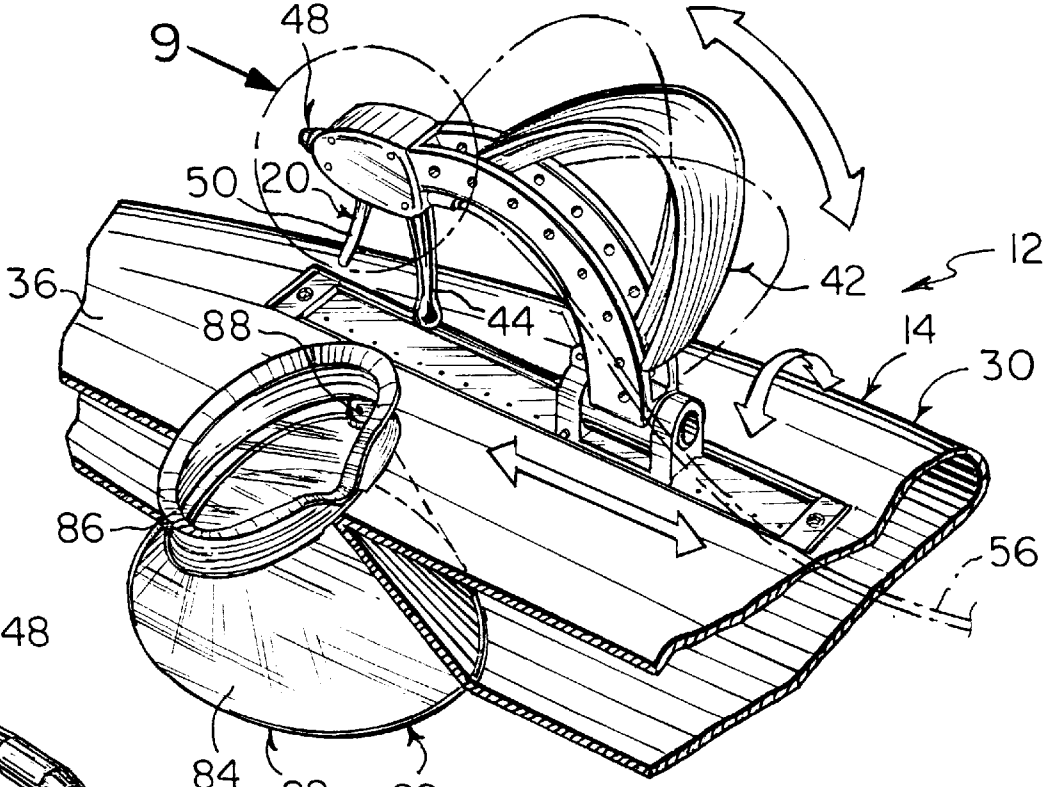
FIG. 8 is an enlarged perspective view similar to FIG. 7 of an area in FIG. 4 indicated by arrow 8, showing the adjustment feature of the shoulder support pad assembly.
Figure 9:
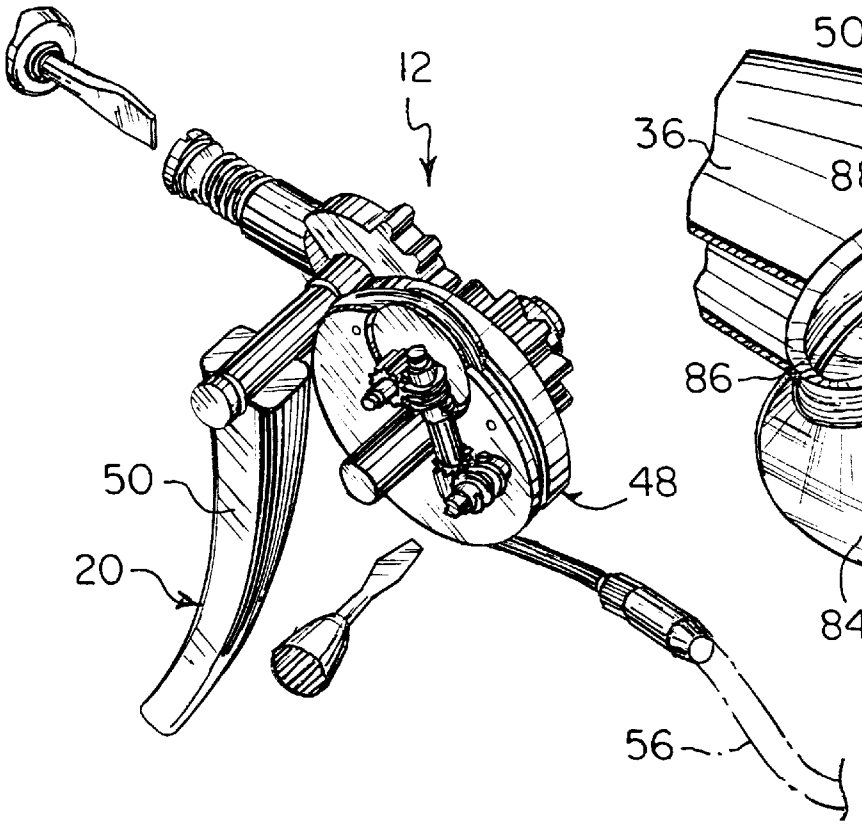
FIG. 9 is a further enlarged perspective view of an area in FIG. 8, with parts broken away, showing the adjustment feature of the steering gear unit.
Figures 10, 11:
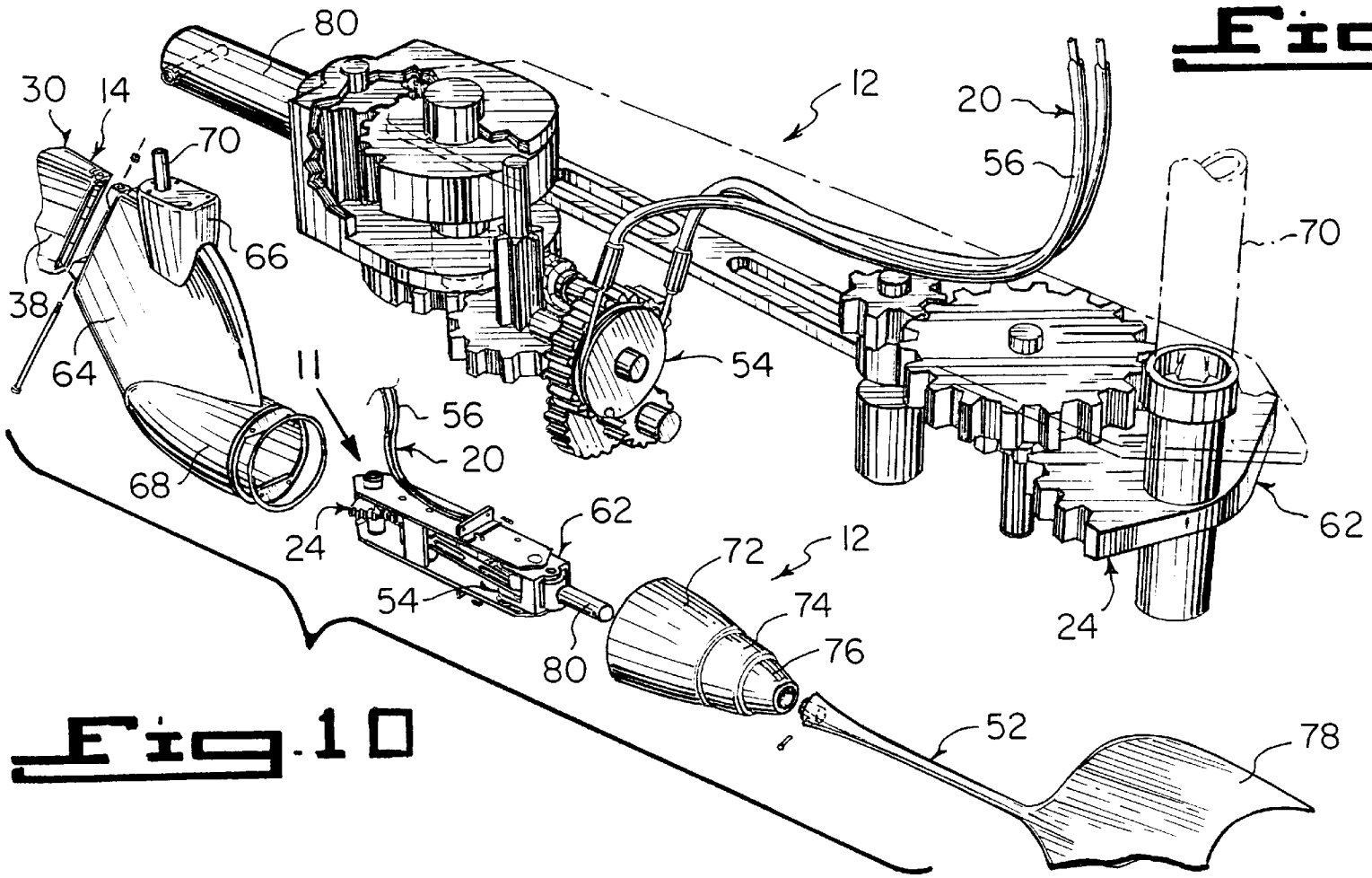
FIG. 10 is an enlarged exploded perspective view of an area in FIG. 4 indicated by arrow 10.
FIG. 11 is a further enlarged perspective view taken in the direction of arrow 11 in FIG. 10, with parts broken away and shown in phantom.

The buoyant support member 30, as best seen in FIG. 4, further includes the upper body support portion 32 having a storage compartment 92 therein for holding various items needed by the person 16. The storage compartment 92 contains a cover 94 with a hinge 96 between the cover 94 and the storage compartment 92. A latch mechanism 98 is between the cover 94 and the storage compartment 92 opposite from the hinge 96, so as to keep the cover 94 closed over the storage compartment 92.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A personal water vehicle comprising:

a) means for supporting a person in a prone position above an upper surface of a body of water;

b) means for steering said supporting means in the body of water, using manual operation by the hands of the person, said steering means including;

i) a pair of adjustable shoulder support pad assemblies, each having a grip handle and mounted spaced apart on a forward end of said supporting means adjacent the starboard side and the port side thereof, so that the shoulders of the person can engage with said adjustable shoulder support pad assemblies, while the hands of the person can grasp said grip handles;

ii) a pair of adjustable cable control gear units, in which each said adjustable cable control gear unit is carried in a forward end of one of said adjustable shoulder support pad assemblies;

iii) a pair of steering levers, in which each said steering lever is connected to one said adjustable cable control gear unit adjacent one said grip handle, so as to be manually operable by one hand of the person;

iv) a tail fin assembly mounted to a rearward end of said supporting means;

v) a steering gear unit carried in said tail fin assembly; and vi) a pair of elongated steering control cables extending between said adjustable cable control gear unit and said steering gear unit, so that when each of said steering levers are manually operated by the hands of the person said tail fin assembly will swivel left and right to steer said supporting means;

c) means for propelling said supporting means in the body of water, using peddle movement by the feet of the person; and d) means for viewing, extending through said supporting means, so that the person can look into the body of water.

2. A personal water vehicle as recited in claim 1, wherein said supporting means is a buoyant support member being hollow, having a bow, stern, deck and hull and fabricated out of a rigid material.

3. A personal water vehicle as recited in claim 2, wherein said buoyant support member includes:

a) an upper body support portion for supporting the upper body of the person in the prone position amidships;

b) a flat streamlined head portion extending forward of said upper body support portion; and c) an elongated stem portion extending aft of said upper body support portion, to supply clearance for the legs of the person during peddling movement by the feet.

4. A personal water vehicle as recited in claim 1, wherein said propelling means includes:

a) a swivel pedal assembly pivotally mounted over the rearward end of said supporting means at said tail fin assembly;

b) a pair of toe clip foot hanger pedals, each mounted on an opposite end of said swivel pedal assembly to engage with one foot of the person;

c) a propulsion gear box carried in said tail fin assembly in conjunction with said steering gear unit, so that when said swivel pedal assembly is rocked forward and rearward by the peddle movement of the feet of the person engaging said toe clip foot hanger pedals, said tail fin assembly will undulate like a fish tail in the body of water to drive said supporting means forward in the body of water.

5. A personal water vehicle as recited in claim 4, wherein said tail fin assembly includes:

a) a vertical stabilizer attached in a removable manner to the rearward end of said supporting means;

b) a pedal mount on said vertical stabilizer;

c) a gear housing to receive said propulsion gear box and said steering gear unit therein, so that a pedal column of said swivel pedal assembly can extend upwardly from said propulsion gear box and through said pedal mount;

d) a housing cap with a flexible rubber cover and tail fin mount base to engage with said gear housing; and e) a tail fin secured to a shaft of said propulsion gear box and said steering gear unit at said tail fin mount base of said housing cap.

6. A personal water vehicle as recited in claim 1, wherein said viewing means is a see through window.

7. A personal water vehicle as recited in claim 6, wherein said see through window includes:

a) a transparent plastic lens extending centrally through said supporting means adjacent a front end thereof; and b) a soft rubber face piece mounted over said lens in a detachable manner, said face piece having an air and water extractor vent to release any air and water when the person places their face against said face piece.

8. A personal water vehicle as recited in claim 3, wherein said buoyant support member further includes said upper body support portion having a storage compartment therein for holding various items needed by the person.

9. A personal water vehicle as recited in claim 8, wherein said storage compartment includes:

a) a cover;

b) a hinge between said cover and said storage compartment; and c) a latch mechanism between said cover and said storage compartment opposite from said hinge, so as to keep said cover closed over said storage compartment.

10. A personal water vehicle as recited in claim 3, wherein said propelling means includes:

a) a swivel pedal assembly pivotally mounted over the rearward end of said supporting means at said tail fin assembly;

b) a pair of toe clip foot hanger pedals, each mounted on an opposite end of said swivel pedal assembly to engage with one foot of the person;

c) a propulsion gear box carried in said tail fin assembly in conjunction with said steering gear unit, so that when said swivel pedal assembly is rocked forward and rearward by the peddle movement of the feet of the person engaging said toe clip foot hanger pedals, said tail fin assembly will undulate like a fish tail in the body of water to drive said supporting means forward in the body of water.

11. A personal water vehicle as recited in claim 10, wherein said tail fin assembly includes:

a) a vertical stabilizer attached in a removable manner to the rearward end of said supporting means;

b) a pedal mount on said vertical stabilizer;

c) a gear housing to receive said propulsion gear box and said steering gear unit therein, so that a pedal column of said swivel pedal assembly can extend upwardly from said propulsion gear box and through said pedal mount;

d) a housing cap with a flexible rubber cover and tail fin mount base to engage with said gear housing; and e) a tail fin secured to a shaft of said propulsion gear box and said steering gear unit at said tail fin mount base of said housing cap.

12. A personal water vehicle as recited in claim 11, wherein said viewing means is a see through window.

13. A personal water vehicle as recited in claim 12, wherein said see through window includes:

a) a transparent plastic lens extending centrally through said supporting means adjacent a front end thereof; and b) a soft rubber face piece mounted over said lens in a detachable manner, said face piece having an air and water extractor vent to release any air and water when the person places their face against said face piece.

14. A personal water vehicle as recited in claim 13, wherein said buoyant support member further includes said upper body support portion having a storage compartment therein for holding various items needed by the person.

15. A personal water vehicle as recited in claim 14, wherein said storage compartment includes:

a) a cover;

b) a hinge between said cover and said storage compartment; and c) a latch mechanism between said cover and said storage compartment opposite from said hinge, so as to keep said cover closed over said storage compartment.

* * * * *